US009011195B2

(12) United States Patent
Sidwell

(10) Patent No.: US 9,011,195 B2
(45) Date of Patent: Apr. 21, 2015

(54) COLLAPSIBLE BALLOON CUP WITH ATTACHABLE INFLATION AIR TUBE

(71) Applicant: Maximum Visibility Solutions, LLC, Duluth, GA (US)

(72) Inventor: Paul E. Sidwell, Duluth, GA (US)

(73) Assignee: Maximum Visibility Solutions, LLC, Duluth, GA (US)

( * ) Notice: Subject to any disclaimer, the term of this patent is extended or adjusted under 35 U.S.C. 154(b) by 129 days.

(21) Appl. No.: 13/724,575

(22) Filed: Dec. 21, 2012

(65) Prior Publication Data

US 2013/0186516 A1 Jul. 25, 2013

Related U.S. Application Data

(60) Provisional application No. 61/579,949, filed on Dec. 23, 2011.

(51) Int. Cl.

| | |
|---|---|
| ***A63H 27/10*** | (2006.01) |
| ***B65B 1/00*** | (2006.01) |
| ***G09F 21/06*** | (2006.01) |
| *A63H 27/00* | (2006.01) |

(52) U.S. Cl.

CPC *B65B 1/00* (2013.01); *A63H 27/10* (2013.01); *G09F 21/06* (2013.01); *A63H 2027/1008* (2013.01); *A63H 2027/1083* (2013.01)

(58) Field of Classification Search

USPC ..... 446/220–226

See application file for complete search history.

(56) References Cited

U.S. PATENT DOCUMENTS

| | | | | |
|---|---|---|---|---|
| 2,664,667 | A | 1/1954 | Burroughs | |
| 3,267,604 | A | 8/1966 | Goldsmith | |
| 4,428,149 | A | 1/1984 | Brown | |
| 4,547,168 | A * | 10/1985 | Blacksberg et al. | 446/222 |
| 4,589,854 | A | 5/1986 | Smith | |
| 4,798,554 | A * | 1/1989 | Nelson et al. | 446/222 |
| 4,837,059 | A | 6/1989 | Milne | |
| 4,884,987 | A | 12/1989 | Mason | |
| 5,021,022 | A | 6/1991 | Ganz | |
| D329,261 | S | 9/1992 | Pollack | |
| 5,295,891 | A | 3/1994 | Schalk | |
| 5,547,413 | A | 8/1996 | Murray | |
| 5,628,091 | A | 5/1997 | Mueller | |
| 5,944,576 | A | 8/1999 | Nelson et al. | |

(Continued)

FOREIGN PATENT DOCUMENTS

| | | |
|---|---|---|
| DE | 20312244 | 10/2003 |
| GB | 274000 | 7/1927 |
| GB | 772150 | 4/1957 |

(Continued)

*Primary Examiner* — Kien Nguyen

(74) *Attorney, Agent, or Firm* — Saliwanchik, Lloyd & Eisenschenk

(57) ABSTRACT

A balloon assembly including a balloon pedestal having a cup attached to a collar and an air tube that can be fixedly attached to a one-way balloon valve. The balloon cup is configured with a plurality of creases that allow it to be folded or otherwise reduced in shape for more economical packaging. The collar and air stem are also oval in shape to further reduce the overall volume of the balloon assembly. The balloon cup can be placed over and secured to the air tube, with the cup supporting the base of the balloon. A rod or similar support can also be placed in the end of the air tube to allow the balloon to be more visible.

24 Claims, 2 Drawing Sheets

(56) References Cited

U.S. PATENT DOCUMENTS

| | | | |
|---|---|---|---|
| 6,375,534 | B1 | 4/2002 | Burns |
| 7,322,073 | B2 | 1/2008 | Cuisinier |
| 7,854,642 | B2 | 12/2010 | Nelson et al. |
| 2007/0249259 | A1 | 10/2007 | Pham |

FOREIGN PATENT DOCUMENTS

| | | |
|---|---|---|
| JP | 60-171494 | 11/1985 |
| JP | 2004-194761 | 7/2004 |
| WO | WO 02-066132 | 8/2002 |
| WO | WO 2004-007043 | 1/2004 |

* cited by examiner 20
32
26
23

100
23
26
20
32
200
30

20
21
30
29
32
22
26
23
100
28
25

29
22
ϕ4.20
6.30
8.00

10

ϕ5.80
71.00
30
32
23
26

4.20
1.80
26
22

200
20
28
32
26
23
25
100

COLLAPSIBLE BALLOON CUP WITH ATTACHABLE INFLATION AIR TUBE

CROSS-REFERENCE TO RELATED APPLICATION

This application claims the benefit of U.S. Provisional Application Ser. No. 61/579,949, filed Dec. 23, 2011, the disclosure of which is hereby incorporated by reference in its entirety, including all figures, tables and amino acid or nucleic acid sequences.

BACKGROUND OF INVENTION

Balloons are a novelty item used for a variety of situations. Celebrations and parties are often made more exciting with a bouquet of colorful balloons. Balloons are also used to draw attention to something and are commonly used as a marketing and sales tactic. Thus, it is important that the balloons be visible and messages or images thereon be easily seen.

There are many different types of balloons as well. Elastic, plastic, or rubberized balloons typically enlarge as they are inflated and the material will stretch. Foil balloons are usually made from thin, unstretchable, metalized plastic films. These types of balloons expand when inflated, but the material of the balloon does not usually stretch and is easily ruptured if the balloons are overfilled.

Inflating balloons can be done by several methods. Smaller balloons can be inflated by mouth, where air is simply blown into an opening or neck in the balloon. More elaborate or larger balloons can be inflated with air tanks containing $NO_2$ or helium. Elastic balloons are typically tied off or have something secured around the mouth of the balloon to prevent air loss. Some balloons, in particular the foil balloons, often have one-way valve pieces that are placed in the opening or neck of the balloon. There are several types of one-way valves utilized in balloons and similar devices. Typically, they utilize some sort of one-way valve that can be opened when air or other gas is being blown into the balloon. Some of the common foil balloons utilize elongated strips of thin, pliable plastic that form a tube within the neck of the balloon. In use, some type of straw or other elongated, hollow instrument can be inserted into one end of the one-way valve and air forced into the balloon, which opens the one-way valve to allow inflation. When air is no longer being forced through the valve, the pliable plastic tube of the one-way valve collapses preventing loss of air from the balloon.

To secure the balloon to a structure or hold it in hand, a ribbon, string or similar material can be tied to the stem of the balloon. However, to keep balloons upright, more visible, and less susceptible to the effects of wind or movement, balloons are often attached to a rigid stem, often fitted to a balloon cup situated around the base and/or neck of the balloon. The balloon cup supports the balloon and allows attachment of a rigid, elongated handle that holds the balloon upright so it does not move and is visible at all times.

The balloon cup is usually molded from plastic, nylon or other material that forms a rigid, solid piece capable of supporting the balloon in an upright position and attachment of the rigid handle. But, because of the volume occupied by the solid, cup-shape of each piece, a limited number of them can be stored on retail shelves or hooks and fewer of them can be packaged in a container. For shipping and storage purposes, it would be more economical if a greater number of the balloon-cups could be packaged into the same space or container. This would reduce storage space and allow more to be placed on shelves and would reduce packaging and shipping costs.

Thus, there is a need for a one-way valve piece that is flexible or collapsible to save space, but is still able to provide sufficient strength to support a balloon and attachment of a rigid handle to maintain it in an upright position, without damaging the balloon, even in windy conditions.

BRIEF SUMMARY

The embodiments of the subject invention solve the above described disadvantages associated with the previously known devices and methods, and provide certain attributes and advantages, which have not been realized by those known devices. In particular, the embodiments of the subject invention provide novel, inexpensive, and highly effective methods and devices for holding a balloon and attaching a rigid handle, which devices can be packaged, shipped, and stored in a smaller volume than the previously known devices.

In accordance with the embodiments of the subject invention, the problem of a balloon-cup formed as a single, rigid, high-volume piece is solved by introducing fold or crease lines within the walls of the balloon cup. These fold or crease lines allow the flared cup to be collapsible, and generally flattened, taking up less volume for packaging and shipping. The balloon cup is able to provide the same support to the balloon and allow attachment of a rigid handle. When utilized with a balloon, the folds in the cup can allow it to expand as the balloon is inflated. Alternatively, the shape can be reformed by squeezing the folded sides of the cup. The base of the balloon can be secured in the cup and the rigid handle attached to maintain the upright, visible position of the balloon.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. It should also be understood that the drawings presented herein may not be drawn to scale and that any indication of dimensions in the drawings or the following description are specific to the embodiments disclosed. Any variations of these dimensions that will allow the subject invention to function for its intended purpose are considered to be within the scope of the subject invention. Thus, understanding that these drawings depict only typical embodiments of the invention and are therefore not to be considered as limiting in scope, the invention will be described and explained with additional specificity and detail through the use of the accompanying drawings in which.

DETAILED DISCLOSURE

Figures 1A, 1B, 2A, 2B, 2C, 2D, 2E, 4:
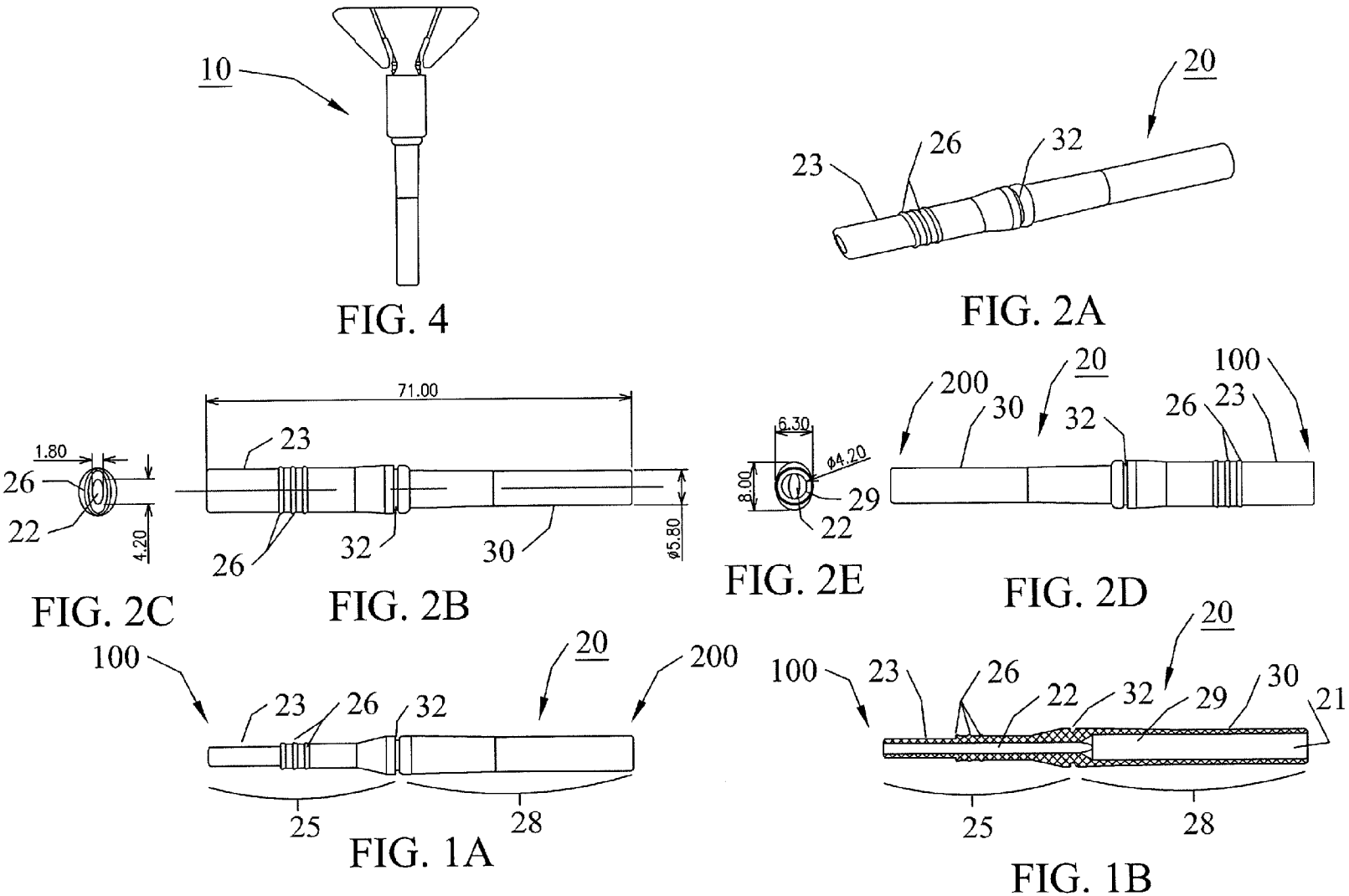
FIG. 1A is a left side elevation view of a first embodiment of an air stem according to the subject invention, in which it can be seen that the diameter of the top end is smaller than the diameter of the bottom end. The right side is a mirror image of this view.
FIG. 1B is a left side elevation cross-sectional view of a first embodiment of an air stem according to the subject invention, in which it can be seen that there is continuous channel through the air stem.
FIG. 2A is a left side perspective view of a second embodiment of an air stem according to the subject invention.
FIG. 2B is a left side elevation view of a second embodiment of an air stem according to the subject invention, in which the continuous channel has a larger diameter at the nozzle end than the first embodiment of an air stem.
FIG. 2C is a top plan view of a second embodiment of an air stem according to the subject invention, in which it can be seen that the nozzle end is generally oval in shape.
FIG. 2D is a right side elevation view of a second embodiment of an air stem according to the subject invention.
FIG. 2E is a bottom plan view of a second embodiment of an air stem according to the subject invention, in which it can be seen that the inflator end is generally circular in circumference.
FIG. 4 is a front elevation view of a balloon cup with an attached air stem.

The subject invention in general describes embodiments of a balloon assembly. More specifically, the subject invention pertains to one or more embodiment(s) of a balloon inflator with a cup support and attached rod holder capable of inflating a self-sealing balloon and holding the inflated balloon aloft even in windy conditions.

The following description will disclose that the subject invention is particularly useful for foil, plastic sheet or other non-latex or non-elastic balloons, in particular self-sealing balloons that utilize flat-film self-scaling valves. However, a person with skill in the art will be able to recognize numerous other uses that would be applicable to the devices and methods of the subject invention. While the subject application describes, and many of the terms herein relate to, a use with self-sealing foil balloons, other modifications apparent to a person with skill in the art and having benefit of the subject disclosure are contemplated to be within the scope of the present invention.

As used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions. The "connection" or "engagement" may be direct or indirect, physical or remote.

Also, reference is made throughout the application to the "proximal end" and "distal end." As used herein, the proximal end is that end of the device to which a balloon would be attached. Conversely, the distal end of the device is that end farthest from the balloon.

The present invention is more particularly described in the following examples that are intended to be illustrative only since numerous modifications and variations therein will be apparent to those skilled in the art. As used in the specification and in the claims, the singular for "a," "an" and "the" include plural referents unless the context clearly dictates otherwise.

Reference will be made to the attached figures on which the same reference numerals are used throughout to indicate the same or similar components. With reference to the attached figures, which show certain embodiments of the subject invention, it can be seen that the subject invention comprises embodiments of a balloon assembly 10 that includes an air tube 20 to which the one-way valve of a balloon can be attached to the proximal end 100 and a balloon pedestal 40 with a cup 60 at the proximal end operably attached to a one-way collar 80 at the distal end that can be slid from the distal end 200 towards the proximal end of an air tube, so the cup can be attached to the base of the balloon.

With reference to FIGS. 1A-2D, it can be seen that an air tube 20 is in general a tubular, straw-like device that can be used to blow air into and inflate a balloon. An air tube can be rigid or semi-rigid and generally linear with a channel therethrough. The length of an air tube can vary depending upon a variety of factors understood to those with skill in the art. Such variations are considered to be within the scope of the subject invention. In one embodiment, the overall length of an air tube is between approximately 65 mm and approximately 75 mm. In a specific embodiment, the length of an air tube is approximately 71 mm.

Many latex and/or foil balloons utilize a one-way valve in the neck of the balloon. Typically, the one-way valves are of the flat-film valve type, because they can be made entirely flat, like the balloon itself prior to inflation. There are several types of flat-film valves utilized, such as, for example, the one disclosed in U.S. Pat. No. 5,860,441. To inflate a balloon having a flat-film one-way valve, the proximal end of an air tube 20 can be inserted into one end of the valve, so that it operably engages with the end of the valve. Forcing air or gas into the valve through the air tube distal end 200 will force the valve to open. When air or gas is no longer being forced through the valve, it collapses to the flattened state preventing the escape of air or gas from the balloon.

An air tube, can therefore, have a proximal portion, or nozzle end 25, that engages with the balloon and a distal portion, or inflator end 28, which can be blown into or used with a hose or other gas source attached to inflate the balloon and which can also act as a rod or stem by which the balloon can be held or secured. There can be a continuous channel therethrough. As will be discussed in further detail below, the balloon pedestal 40 can also be engaged with the air tube to support the balloon in an upright position.

To ensure that the air tube is operably connected with the one-way valve, it can be advantageous for the air tube to be fixedly attached to the end of the one-way valve. This ensures that when the balloon reaches the consumer, the air tube and valve are properly operably connected. This can be accomplished by securing the neck of the balloon, with the associated one-way valve therein to the proximal end of the balloon. This can be accomplished by any of a variety of techniques or devices known in the art, including, but not limited to, heat sealing, crimping, adhesives, bands, or other means that may be known to those with skill in the art, to provide an airtight seal between the balloon neck and the nozzle end.

In one embodiment, nozzle end 25 is configured with one or more structures that can facilitate connection of the balloon neck. Such structures can be, for example, indentations, projections, ridges, roughened or unfinished areas, surface imperfections, or other similar structures. In one embodiment, the nozzle end 25 is configured with one or more ribs 26 that encircle the nozzle end, such as shown, for example, in FIGS. 1A-2D to which the open end of the balloon neck and/or the one-way valve are connected.

Typically, air nozzles have a generally circular circumference, with the opening therethrough also being circular. The embodiments of the subject invention can be configured to operate with the circular air nozzles currently known in the art. However, in an alternative embodiment, the nozzle end 25 is slightly flattened, so that the nozzle channel 22 and the nozzle wall 23 form an elliptical shape, such as shown, for example, in FIGS. 2C and 2E. In one embodiment, the width of the minor axis of the nozzle channel is between approximately 1.5 mm and 2.0 mm and the width of the major axis of the nozzle channel is between approximately 4.0 mm and 4.5 mm. In a specific embodiment, the width of the minor axis of the nozzle channel is approximately 1.8 mm and the width of the major axis of the nozzle channel is approximately 4.2 mm.

The inflator end 28 and the inflator channel 29 can be generally circular, such as shown, for example, in FIG. 2D. The embodiments of the subject invention can be configured to operate with such generally circular configurations. Alternatively, the inflator channel can be flattened, similarly to the air nozzle, as described above. In one embodiment, the inflator wall has a circular diameter of between approximately 5.5 mm and 6.0 mm. In a more specific embodiment, the inflator wall has a circular diameter of approximately 5.8 mm. In a further embodiment, the inflator channel has a circular diameter of between approximately 4.0 mm and 4.5 mm. In a specific embodiment, the inflator channel has a diameter of approximately 4.2 mm.

In order to provide greater visibility to a balloon, a rod, stick or similarly rigid or semi-rigid apparatus can be inserted into the distal end 200 of the inflator end. This can elevate the balloon and provide greater visibility.

Depending upon the size of the balloon and/or the one-way nozzle, it may be beneficial for the nozzle end of the air tube to have an overall smaller diameter than the inflator end. FIGS. 1A and 1B illustrate an embodiment wherein the nozzle end and the nozzle channel have an elliptical shape, wherein the diameter of their major axes have a smaller diameter than the diameter of the inflator wall and the inflator channel, respectively.

The balloon pedestal 40 includes a cup 60 attached to a one-way collar 80. The cup 60 and collar 80 engage with the balloon and the air tube, respectively. The overall length dimensions of the balloon pedestal can vary, usually depending upon the size of the balloon and/or the air tube to which it will be engaged. Thus, the balloon pedestal of the subject invention is amenable for use with smaller 9"-18" balloons, but can easily be adjusted in size to operate with balloons that are much larger. In one particular embodiment, the overall length of the balloon pedestal, from the proximal end of the cup to the distal end of the collar is between approximately 30 mm and approximately 40 mm. In a more specific embodiment, the overall length of the balloon pedestal, from the proximal end of the cup to the distal end of the collar is approximately 34.50 mm. Other embodiments, as mentioned above, have overall lengths that are smaller or larger, depending upon the size and type of balloon. Further, other dimensions, as will be described below can also vary depending upon the size and type of balloon.

The cup is, in general, a V-shaped receptacle in which the neck of the balloon is attached. The flared V-shape holds the neck of the balloon, supports the balloon, and helps maintain it in an upright position, usually even if the balloon is slightly deflated. In one embodiment, the cup 60 is formed with a plurality of folds or creases 61 that divide the cup into several attached rigid or semi-rigid panels 62, such as shown, for example in FIGS. 3A-F. The creases 61 are flexible and allow movement between the panels 62. More particularly, the creases allow the panels to be pushed together or flattened to reduce the overall volume of the cup when not in use. In one embodiment, the cup is divided into six panels. However, it should be understood that the cup could be divided into more or fewer panels or even or odd number, depending upon a variety of factors known to those with skill in the art. Such variations are considered to be within the scope of the subject invention.

To further facilitate folding and/or flattening of the cup, there can be one or more cut-outs 63 between the panels and/or the creases, such as shown, for example, in FIGS. 3A-F. The cut-outs permit the panels to be pressed more closely together because the edges don't abut each other when brought into close proximity. Advantageously, the cut-outs also reduce the overall weight of the device, which is a benefit to shipping and packaging. The cut-outs can also be varied so that they have different shapes or configurations that may be similar to or complement the balloon or have some other aesthetic appeal as well as function.

Typically, the balloon assembly, including the balloon cup and air tube, is pre-attached to a balloon. Thus, when received by a consumer, the balloon and balloon assembly are already engaged. When the balloon is inflated, the cup can expand simultaneously to form a support for the balloon. The neck of the balloon, typically secured within the balloon cup, usually has an oval circumferential shape after the balloon is inflated. Thus, it can be beneficial if the shape of the cup matches or resembles the shape of the balloon neck. FIG. 3C illustrates an embodiment, wherein the expanded cup has a more oval shape. In one embodiment, the length of the cup is between approximately 35 mm to approximately 40 mm. In a further embodiment, the width of the cup is between approximately 15 mm and approximately 25 mm. In a more specific embodiment, the length of the cup is approximately 38.97 mm. In a still further more specific embodiment, the width of the cup is approximately 20.0 mm.

The attachment of the cup 60 to the collar can be achieved by fixedly attaching one or more of the panels to, or at about, the proximal end of the collar wall 81. In one embodiment, the distal ends of two panels are attached to the collar wall by a flexible flange 65. In a further embodiment, the distal ends of two panels disposed opposite to each other in the cup are attached to the collar wall by a flexible flange 65, such as seen, for example, in FIG. 3B. A flexible flange can be similar to a crease 61, described above, in that it allows the attached panels 61 to move and be folded or flattened towards each other. They also permit the panels to move apart when the balloon is inflated.

The collar can be a generally tubular structure where the collar wall 81 forms a central channel 82. To arrange the balloon assembly 10, the collar can engage with the air tube 20 by sliding the distal end of the air tube, which end is not attached to the balloon, past the cup and into the proximal end of the collar, so that the central channel 82 can slide up the air tube, with the cup towards the balloon. It can be beneficial for the collar to be used with standard, round air tubes which are currently known in the art. Thus, a manufacturer could utilize a balloon cup of the subject invention with standard air tubes. However, as mentioned above, one advantage of the embodiments of the subject invention is the reduced volume in which the balloon pedestal can be packaged and stored. To further reduce the overall volume of the balloon pedestal, the circumferential shape of the collar wall 81 can be oval. In a further embodiment, the circumferential shape of the collar channel 82 can be oval. In a still further embodiment, the oval dimensions of the collar channel 82 are compatible with those of the air tube, particularly the elliptical dimensions of the nozzle wall 23 at the nozzle end 25. Thus, when the shape of the collar is aligned with the shape of the air tube, the collar can be slid over the inflator end 28 and onto the nozzle end, so that the cup is against the balloon.

Figure 3A:
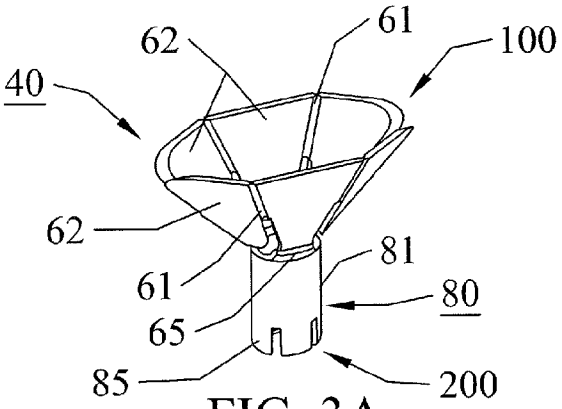
FIG. 3A is a perspective view of an embodiment of a balloon-cup according to the subject invention.
Figure 3B:
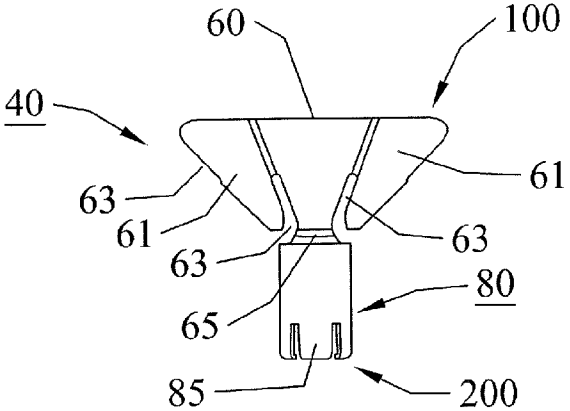
FIG. 3B is a front elevation view of a balloon cup according to the subject invention in which the opposite panels are attached from the air stem.
Figure 3C:
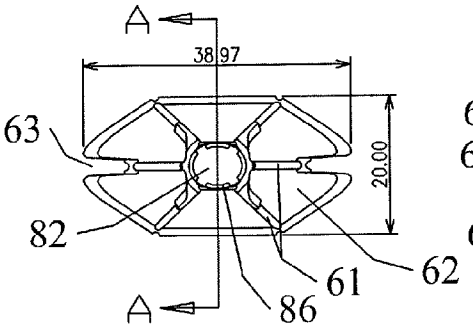
FIG. 3C is a top plan view of a balloon-cup according the subject invention in which the shape of the balloon-cup can be seen. Line A-A indicates the direction of the cross-section shown in FIG. 3D.
Figure 3D:
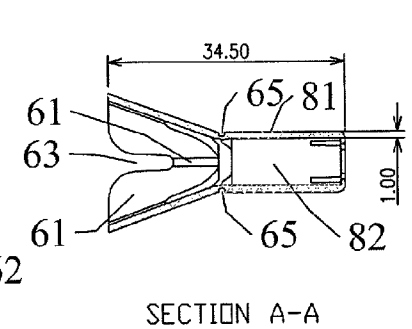
FIG. 3D is a left side elevation cross-sectional view of an embodiment of a balloon cup according to the subject invention.

In a specific embodiment, shown, for example, in FIGS. 3A and 3B, the flexible flanges 65 are attached to the longer side, or major axis side, of the oval collar. With this embodiment, when the attached panels are flattened towards each other and the remaining panels are folded along their respective crease, the overall thickness of the balloon pedestal is between approximately 5 mm and approximately 13 mm. In a specific embodiment, when the attached panels are flattened towards each other and the remaining panels are folded along their respective crease, the overall thickness of the balloon pedestal is approximately 10.0 mm.

Figure 3E:
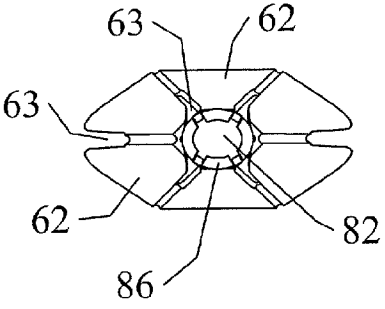
FIG. 3E is a bottom plan view of an embodiment of a balloon cup according to the subject invention, in which the pawls in the air stem can be seen.
Figure 3F:
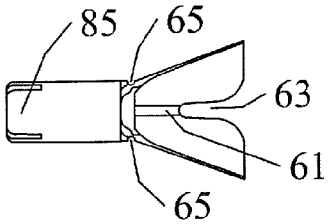
FIG. 3F is a left side elevation view of an embodiment of a balloon cup according to the subject invention, in which it can be seen that the front and back panels are attached, but the side panels are not attached. The right side elevation view is a mirror image of this view.

When the balloon pedestal 40 is assembled with the air tube 20, the cup should be pressed against the base of the balloon and around the neck of the balloon, so that it can support the balloon and hold it upright after it is inflated. This can necessitate the balloon pedestal, after being slid over the air tube, being held in place relative to the air tube. In one embodiment, a tab and slot configuration is used, wherein the collar has one or more tabs that fit into one or more slots within the air tube. FIGS. 1A, 2A and FIG. 3B illustrate an example of this embodiment, wherein the collar is configured with one or more spring-action tabs 85 at the distal end. In a specific embodiment, the collar is configured with at least four spring-action tabs 85 at the distal end, an example of which is shown in FIG. 3E. In a further embodiment, the spring-action tabs are configured with one or more teeth 86. The air tube can be configured with a slot 32 which is operably connectable with the spring-action tabs, specifically with the teeth 86 which fit therein, when the balloon pedestal is slid up the air tube. The location of the slot, usually between the nozzle end 25 and the inflator end 28, when the teeth of the spring-action tabs engage therewith, will ensure that the cup is in the proper position against the balloon.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

It should be understood that the examples and embodiments described herein are for illustrative purposes only and that various modifications or changes in light thereof will be suggested to persons skilled in the art and are to be included within the spirit and purview of this application.

It should be understood that any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. Further, when a particular feature, structure, or characteristic is described in connection with any embodiment, it is submitted that it is within the purview of one skilled in the art to affect such feature, structure, or characteristic in connection with other ones of the embodiments.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modifications, both as to equipment details and operating procedures can be effected without departing from the scope of the invention itself. Further, it should be understood that, although the present invention has been described with reference to specific details of certain embodiments thereof and by examples disclosed herein, it is not intended that such details should be regarded as limitations upon the scope of the invention except as and to the extent that they are included in the accompanying claims.

I claim:

1. A collapsible balloon pedestal for inflating and supporting a balloon comprising:

a balloon cup having a proximal end and a distal end, wherein the cup comprises a plurality of folds or creases that divide the cup into multiple attached, rigid or semi-rigid panels, wherein the panels form a V-shaped container with a narrower open distal end; and a collar fixedly attached to at least one panel at the distal end of the balloon cup, wherein the collar comprises a tubular structure having a central channel; and an air tube having an inflator end that has an inflator wall defining an inflator channel and a nozzle end that has a nozzle wall defining a nozzle channel, wherein the inflator channel and the nozzle channel are continuous and wherein the nozzle end is adapted to operably connect to the central channel on the collar.

2. A collapsible balloon pedestal according to claim 1, wherein the balloon cup has a circumferential shape that resembles the shape of a balloon neck inflated therein.

3. A collapsible balloon pedestal according to claim 2, wherein the collar is fixedly attached to two panels.

4. A collapsible balloon pedestal according to claim 3, wherein the collar is fixedly attached to the two panels by a flexible flange.

5. A collapsible balloon pedestal according to claim 4, further comprising one or more cut-outs between the proximal end and the to the creases between opposite panels.

6. A collapsible balloon pedestal according to claim 5, wherein the creases and cut-outs in the balloon cup and the flexible flange on the collar allow the balloon pedestal to be substantially flattened.

7. A collapsible balloon pedestal according to claim 6, wherein the thickness of the substantially flattened balloon pedestal is between approximately 5 mm and approximately 13 mm.

8. A collapsible balloon pedestal according to claim 7, wherein the thickness of the substantially flattened balloon pedestal is approximately 10.0 mm.

9. A collapsible balloon pedestal according to claim 8, wherein the length from the proximal end of the panels to the distal end of the collar is approximately 34.5 mm.

10. A collapsible balloon pedestal according to claim 7, wherein the length from the proximal end of the panels to the distal end of the collar is between approximately 30 mm and approximately 40 mm.

11. A collapsible balloon pedestal according to claim 6, wherein the cup comprises six creases that divide the cup into six panels.

12. A collapsible balloon pedestal according to claim 6, wherein the balloon cup comprises at least two panels and up to ten panels.

13. A collapsible balloon pedestal according to claim 1, wherein the collar has a circumferential shape that is oval.

14. A collapsible balloon pedestal according to claim 13, wherein the nozzle wall and nozzle channel are elliptical in shape.

15. A collapsible balloon pedestal according to claim 14, wherein the inflator wall and inflator channel are elliptical in shape.

16. A collapsible balloon pedestal according to claim 15, further comprising a slot on the air tube for operably connecting with the collar.

17. A collapsible balloon pedestal according to claim 16 wherein the collar comprises one or more spring-action tabs having one or more teeth that operably connect with the slot on the air tube to secure the position of the balloon pedestal.

18. A collapsible balloon pedestal according to claim 15, wherein the collar is a one-way collar.

19. A collapsible balloon pedestal according to claim 18, further comprising one or more structures on the nozzle wall to facilitate attachment of the nozzle end to a balloon valve.

20. A collapsible balloon pedestal according to claim 19, further comprising a rigid or semi-rigid rod inserted into the inflator channel.

21. A collapsible balloon pedestal according to claim 15, wherein the nozzle wall has a major axis diameter that is smaller than a major axis diameter of the inflator wall.

22. A collapsible balloon pedestal according to claim 15 wherein the nozzle wall has a major axis diameter that is greater than a major axis diameter of the inflator wall.

23. A collapsible balloon pedestal according to claim 1, wherein the length of the air tube is between approximately 65 mm and approximately 75 mm.

24. A collapsible balloon pedestal according to claim 23, wherein the length of the air tube is approximately 71 mm.

* * * * *